United States Patent [19]

Byrne et al.

[11] Patent Number: 5,028,276

[45] Date of Patent: Jul. 2, 1991

[54] METHOD FOR MAKING LITHOPLATE HAVING IMPROVED GRAINABILITY

[75] Inventors: Stephen C. Byrne, Monroeville; M. Elise Hyland, Oakmont, both of Pa.

[73] Assignee: Aluminum Company of America, Pittsburgh, Pa.

[21] Appl. No.: 481,015

[22] Filed: Feb. 16, 1990

[51] Int. Cl.[5] ..... C22F 1/04

[52] U.S. Cl. ..... 148/11.5 A; 148/2; 148/12.7 A; 148/439; 148/440

[58] Field of Search ..... 148/2, 11.5, 12.7 A, 148/439, 440

[56] References Cited

U.S. PATENT DOCUMENTS

| | | | |
|---|---|---|---|
| 4,301,229 | 11/1981 | Sakaki et al. | 430/158 |
| 4,377,447 | 3/1983 | Bednarz | 204/15 |
| 4,415,374 | 11/1983 | Young et al. | 148/11.5 A |
| 4,600,482 | 7/1986 | Mohr | 204/129.4 |
| 4,634,656 | 1/1987 | Ohashi et al. | 430/278 |
| 4,686,083 | 8/1987 | Takizawa et al. | 420/548 |
| 4,699,673 | 10/1987 | Kobayashi et al. | 148/11.5 A |
| 4,729,939 | 3/1988 | Nishikawa et al. | 430/278 |
| 4,753,685 | 6/1988 | Usui et al. | 148/11.5 A |
| 4,818,300 | 4/1989 | Rooy et al. | 148/11.5 A |
| 4,872,921 | 10/1989 | Teirlinck | 148/11.5 A |
| 4,902,353 | 2/1990 | Rooy et al. | 148/2 |
| 4,915,800 | 4/1990 | Nakanishi et al. | 204/129.4 |

*Primary Examiner*—Upendra Roy

*Attorney, Agent, or Firm*—David W. Pearce-Smith

[57] ABSTRACT

An improved method of treating an ingot to be made into lithoplate. The method also includes homogenizing and hot and cold rolling the ingot, heating the sheet to cause the formation of crystalline oxides on the surface and then cold rolling the sheet to a finished gauge workpiece.

18 Claims, 3 Drawing Sheets

1000X 10 µm

METHOD FOR MAKING LITHOPLATE HAVING IMPROVED GRAINABILITY

BACKGROUND OF THE INVENTION

This invention relates to a method for making an aluminum lithographic plate which is more commonly identified as lithoplate. More particularly, it relates to an improvement in the method of making a workpiece having improved grainability.

Lithography is defined as the process of printing from a plane surface such as a stone or metal plate on which the image to be printed is ink-receptive and the blank area ink-repellant. The stone or metal plate is referred to as lithoplate, but for purposes of discussing this invention and its background, lithoplate will always refer to metal, or more particularly, an aluminum alloy. In addition, although the term "lithoplate" incorporates the word "plate", lithoplate is not necessarily a plate. Rather, lithoplate is used to describe products that might otherwise be considered to be sheet or foil.

The ink-receptive and ink-repellant areas on lithoplate are developed by subjecting the plate to contact with water in the printing press. The image area is hydrophobic or water-repellant, and the non-image area is hydrophilic or water-retentive. The inks used for printing are such that they will not stick or adhere to wet surfaces and, thus, when the lithoplate is contacted with an ink-laden roller, ink is transferred only to the image area.

It is evident that the quality or suitability of a lithoplate for printing is directly related to the hydrophobic and hydrophilic characteristics of the image and non-image areas. It has long been known that uniform roughening of the surface by a process known as "graining" is advantageous in developing both the hydrophobic and hydrophilic areas.

To make the image area, a lithoplate workpiece is coated with a hydrophobic light-sensitive coating material. This material also is resistant to attack or dissolution from acids until it is exposed to light and is commonly called a resist. After the workpiece has been coated with the resist, a negative having the desired image thereon is overlaid on the resist-coated workpiece and exposed to light. In the non-image area, the light causes a reaction in the resist which makes it soluble in acid and, thus, after exposure to light, the plate is contacted with acid to remove the resist in the non-image area. Hydrophobic resist material remains, therefore, only in the image area, and the underlying grained metal surface is advantageous in bonding the resist to it. In the non-image area, with the resist removed, the grained surface is advantageous in enhancing the water retention character of the surface.

Originally, graining of the workpiece was accomplished mechanically by ball graining or brushing. In ball graining, a slurry of steel balls and abrasive material is agitated on the workpiece with the extent of roughening controlled by such things as the type of abrasive, number of balls, speed of agitation, etc. In brush graining, brushes are rotated or oscillated over the surface covered with an abrasive slurry. Mechanical graining usually requires cleaning the plate to make it suitable for further processing. Typically, cleaning is accomplished by immersion in a commercial caustic type solution. It is evident that uniformity and quality of the roughened surface is difficult to control with such methods. In addition, mechanical graining may be relatively slow and costly.

Because of difficulties in mechanical graining, the constant growth of lithographic printing, higher operating speeds of modern printing presses, need for longer lithoplate life, etc., increasing attention has been given to chemical and electrochemical methods of graining. By these methods, the grain is produced by a controlled etching of the surface by the use of chemicals alone or the combination of passing current through a chemical solution. U.S. Pat. Nos. 4,301,229, 4,377,447 and 4,600,482 are cited as examples of many that are directed to electrochemically graining. Whether mechanically grained or electrochemically grained, lithoplate workpieces have certain requirements in common. Lithoplate is used in light gauges, such as 0.008 or 0.012 inch, for example, and by the nature of its use, it must be relatively flat. The surface should be free of imperfections such as deep gouges, scratches and marks which would interfere with the production of a uniform grained surface. From the standpoint of economics or commercial utilization in making aluminum lithoplate, it is desirable that it be produced from an aluminum alloy which can be rolled to the light gauges noted above at reasonable production rates and reasonable levels of recovery or scrap loss. It is also desirable that the alloy from which the lithoplate is made be one which produces reasonably uniform grain when rolled to finished gauge.

In addition, it has become a common practice to apply an anodized finish to the grained surface, whether mechanically or electrochemically produced. It is desirable, therefore, that the aluminum alloy and fabricating practices used to make lithoplate be such that the sheet responds well to anodizing; that is, be uniform in color and relatively free from streaks.

Heretofore, a number of aluminum alloys have been tried and evaluated for the commercial production of lithoplate to be mechanically grained, and the most widely used alloys today are 3000 and 1000 series commercial Aluminum Association alloys (3XXX and 1XXX). In consideration of all of the foregoing lithoplate requirements, these alloys have been determined to be the best from the sheet manufacturer and lithoplate maker or user point of view. With respect to electrochemical graining, however, the response of an aluminum alloy to the particular chemicals employed is obviously an important factor, and these alloys are generally not preferred for graining by such methods.

It would be desirable, therefore, to provide a workpiece fabricated from non-heat treatable alloys such as 3000, 1000 and 5000 series commercial Aluminum Association alloys which would be suitable for graining by either a chemical or electrochemical method.

SUMMARY OF THE INVENTION

By a method of this invention, an aluminum alloy is cast into an ingot which is homogenized, preheated before being hot rolled, cold rolled, subjected to a high temperature anneal, scalped and cold rolled to a relatively thin gauge as a lithoplate workpiece. The workpiece may then be chemically or electrochemically grained to produce a suitable surface for lithographic printing. If desired, the grained surface may be anodized.

A method of this invention is an improvement over methods known heretofore for making lithoplate by controlling the time and temperature of a high temperature batch anneal so as so to cause the formation of crystalline oxides on the surface of the metal. The crystalline oxides grow at the interface of the metal and native amorphous oxide layer. It is believed that the heating need not be sufficient to cause crystalline growth throughout the entire cross-section of the amorphous oxide layer.

As will be discussed in greater detail below, in the preferred method of the invention the high temperature anneal is performed prior to the final cold rolling the reroll stock to finish gauge using practices appropriate for producing a lithoplate workpiece. The workpiece thus produced is then grained by a chemical or electrochemical method to develop a desired grain and the grained surface may then be anodized.

A lithoplate produced by a method of this invention which includes anodizing the grained surface to form a surface that is substantially streak-free and substantially free of ungrained areas. Although streaks in the anodized finish usually have no adverse effect on the printing function of the lithoplate, streaks are undesirable from a commercial point of view because many lithoplate users consider the presence of streaks to be an indication of an inferior lithoplate and will not accept a lithoplate unless it has a substantially uniform appearance.

A lithoplate produced by a method of this invention may be provided with a grain which is substantially uniform in depth and color by either mechanically or electrochemically graining.

It is an objective of a method of this invention to make a lithoplate which has a substantially uniform electrochemically grained finish.

It is an advantage of a method of this invention that lithoplate may be produced from a single alloy which is suitable for graining by mechanical or electrochemical methods.

These and other objectives and advantages of the present invention will be more apparent with reference to the following description of a preferred embodiment, the appended claims and accompanying drawings.

DESCRIPTION OF A PREFERRED EMBODIMENT

Figure 1:
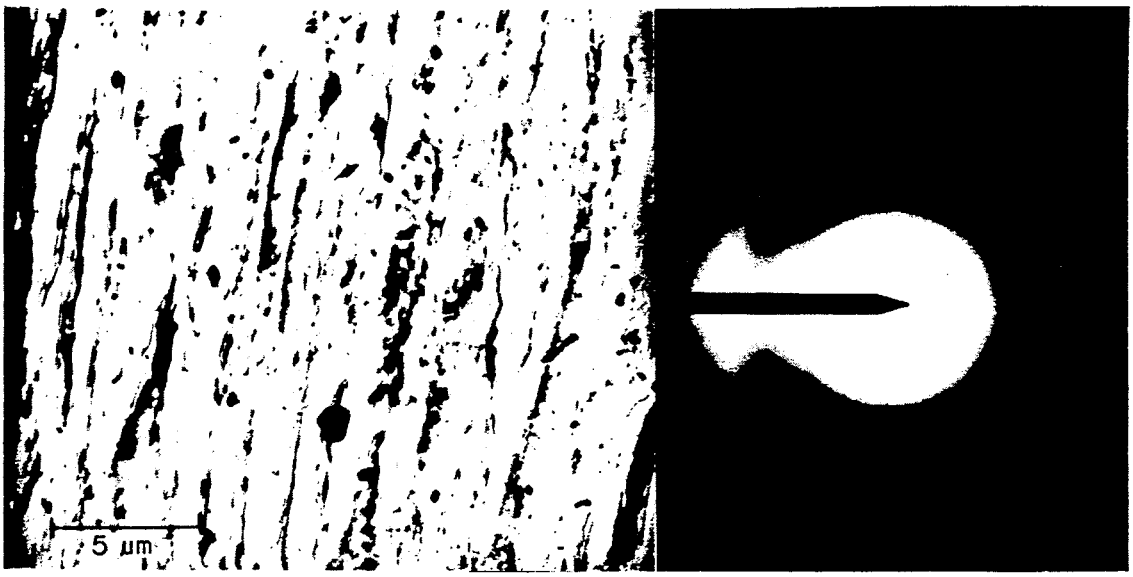
Figure 1 (Prior Art)
FIG. 1 is a transmission electron photomicrograph (TEM) of a prior art lithoplate magnified 25,000 times and an electron diffraction pattern of a portion of the surface oxide.

The aluminum alloy for use in a method of this invention is predominantly aluminum but includes magnesium, silicon, iron and may include other elements as well. As noted earlier, the non-heat treatable commercial Aluminum Association alloys for making a lithoplate are 1000, 3000 and 5000 series alloys.

It is known that 3103 alloy is suitable for rolling into sheets to receive an anodized finish. However, the chemical grainabilty of the 3103 alloy has not been found to be ideal for some applications. Surprisingly, if 3103 is subjected to a high temperature intermediate anneal the grainability of the alloy improves. The term "high temperature" is used herein to refer to a temperature at which transition oxides of alumina will form. The term "batch anneal" is used herein to refer to a non-continuous anneal. The term "intermediate anneal" is used herein to refer an anneal that is performed before rolling to final gauge.

For purposes of this invention, it is preferred that casting of the ingot be controlled to produce an homogenous structure. This may be accomplished by use of a proper grain refiner when DC casting an ingot, control of casting conditions employing appropriate molten metal treatment practices, i.e., fluxing and filtration, to remove nonmetallic inclusions, using a proper casting speed and maintenance of a suitable depth of molten metal while casting, controlling the temperature of casting the ingot, and controlling the homogenizing and preheat temperatures employed prior to hot rolling the ingot. All of the foregoing variables in casting and preparing an ingot for hot rolling are important in producing a satisfactory sheet to make lithoplate by a method of this invention and preferred parameters of each of these variables is well known to those skilled in the art and need not be discussed in great detail.

Removal of undesirable nonmetallic inclusions such as oxides, carbides, etc., in the molten metal is also important in a process of this invention to prevent such nonmetallic incusions from being cast into the ingot. Suitable methods for removing nonmetallic inclusions are known in the art, such as fluxing the molten bath with an active gas such as chlorine, and/or passing the molten metal through filters prior to casting, for example.

The remaining factor to be controlled with respect to casting the ingot is the temperature. It should be cast at a relatively high incoming temperature; that is, 1310°±20° F.

Preferably, the ingot is homogenized at a relatively high temperature to assist in developing a fine uniform microstructure in order to develop a fine uniform surface on the sheet. For 3103 alloy, the homogenization temperature and time should be 1110°±20° F. for a time to insure homogenization, such as approximately 4 hours, for example. The ingot should then be cooled to a temperature of 905° F. or less at a rate of 68° F./hour. Below 905° F., the cooling rate is not critical and the ingot may be allowed to cool to room temperature if desired.

After the ingot has been homogenized as just described, it should be scalped preliminary to hot rolling. The depth of scalp may vary but should be of sufficient depth to remove the zone of metal, generally referred to as the disturbed zone, which includes coarse dendrite cells and "fir tree" or "dendritic" structure, for example. For a typical DC cast ingot, the scalp is typically ¾ inch/side.

The ingot is then preheated to bring it to the proper rolling temperature. The initial set temperature in preheating should be approximately 1100° F.±20° F. to insure that it is completely heated, and thereafter the ingot should be allowed to cool to an initial rolling temperature of 860°±30° F. and maintained at that temperature for one hour. The holding temperature need be only that necessary to uniformly heat the ingot. The ingot is then hot rolled and cold rolled.

All of the foregoing steps relate to practices that are well known to those skilled in the art of casting and hot rolling ingot. Each of the foregoing steps is related to metallurgical control of the ingot to be used in rolling a lithosheet which will respond favorably to graining and application of an anodized finish; that is, having a uniform grained surface which is substantially free from streaks or other defects attributable to metallurgical flaws.

After hot rolling the ingot is cold rolled to a gauge of typically about 0.063 inches, the sheet or plate is subjected to a high temperature anneal. The anneal is at a temperature above which crystalline alumina oxides will begin to form at the metal/oxide interface. The gamma alumina oxides begin to form about 850° F and eta alumina oxide forms as low as 500° F. It is believed that heating to at least 800° F for at least I hour will furnish sufficient heat to produce the amount of crystalline growth required for the present invention to work. Those skilled in the art will understand that the maximum upper limit of the intermediate anneal is the liquidus temperature of the alloy.

After the high temperature intermediate anneal, the sheet is cooled to and rolled to 0.0116 inch, which is the final gauge.

After the sheet has been fabricated as just discussed, at least one side is grained by either a chemical or electrochemical method. A workpiece made by a method of this invention is suitable for graining either chemically or electrochemically. Pieces were grained by immersion in an electrolytic acid bath and were then processed and anodized using practices and procedures which are known to those skilled in the art. Craters on the sample produced by a method of this invention are more uniform in size and more evenly distributed over the surface than samples of the same alloy without the benefit of the high temperature anneal of the present invention.

The following examples illustrate the preferred method of practicing the present invention and the advantage of the present invention over the prior art.

EXAMPLE 1 (PRIOR ART)

Figure 2:
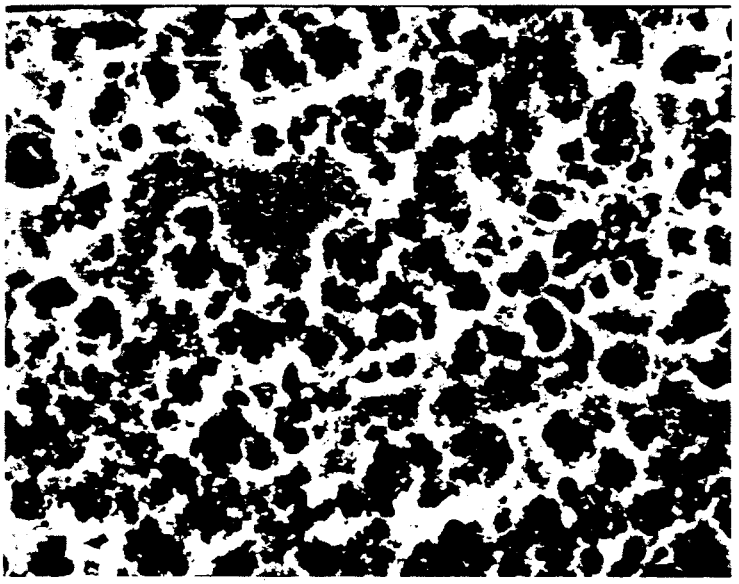
Figure 2 (Prior Art)
FIG. 2 is a scanning electron photomicrograph (SEM) of the electrochemically grained surface of the prior art lithoplate of FIG. 1, magnified 1,000 times.

An sheet of 3103 aluminum alloy is formed by hot rolling to 0.250 inches and cold rolling to 0.063 inches. The sheet is then subjected to a standard anneal to demonstrate the condition of prior art lithoplate. The standard anneal is performed by heating the sheet to 665° F. at a rate of 80° F. per hour and holding it at 665° F. for 2 hours. Afterwards the sheet is cooled at a rate of 80° F. per hour until it reaches 450° F. and then air cooled and cold rolled to a final workgauge of 0.0116 inches. The microstructure of the surface oxide of the final sheet was examined by transmission electron photomicrography (TEM) and the results can be seen in FIG. 1. FIG. 1 show the surface of magnified 25,000 times as well as an electron diffraction pattern of a portion of the surface. The surface of the sheet was observed to be amorphous and this observation is confirmed by the diffused diffraction pattern. Next, the surface of one side of the sheet was electrochemically grained. The results are seen in FIG. 2 which is a scanning electron photomicrograph (SEM) of the electrochemically grained and anodized surface magnified 1,000 times. The plateau in the upper left quadrant of the SEM photograph is in an ungrained area.

EXAMPLE 2

Figure 3:
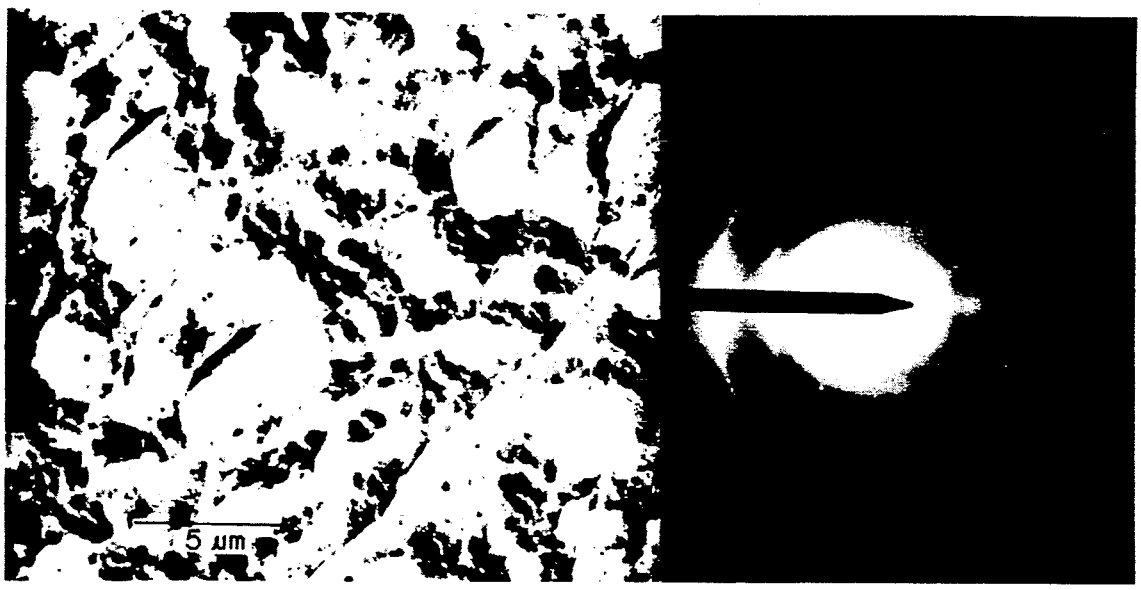
FIG. 3 is a transmission electron photomicrograph (TEM) and electron diffraction pattern of the surface oxide of a prior art lithoplate magnified 25,000 times made by a method of this invention.
Figure 4:
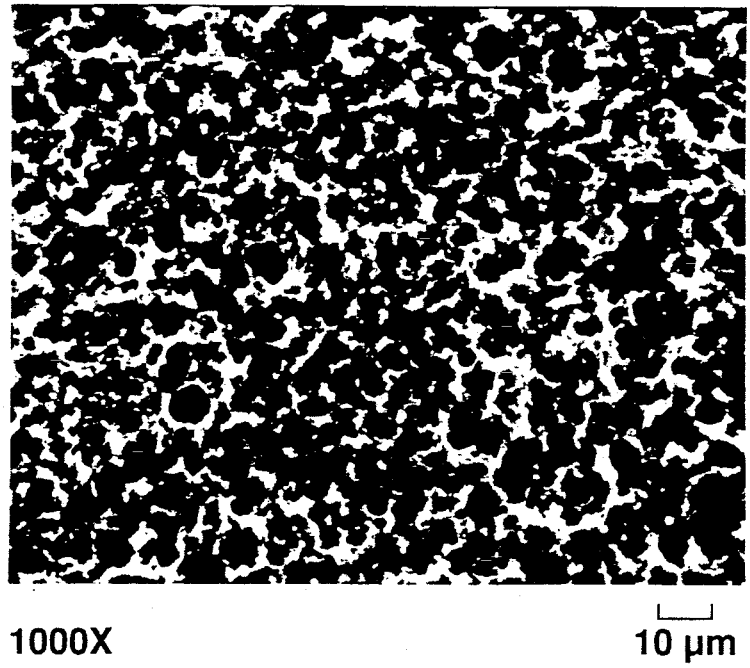
FIG. 4 is a scanning electron photomicrograph (SEM) of the electrochemically grained surface of the lithoplate of FIG. 3, magnified 1,000 times.

A sample of the same sheet of 3103 aluminum alloy as used in Example 1 is subjected to an anneal of the present invention. The anneal is performed by heating the sheet to 1100° F at a rate of 80° F per hour and holding it at 1100° F for 2 hours. Afterwards the sheet is water quenched and cold rolled to a final workgauge of 0.0116 inches. The microstructure of the surface oxide on the final sheet was examined by TEM and X-ray and the results can be seen in FIG. 3. FIG. 3 shows the surface of magnified 25,000 times as well as an electron diffraction pattern of a portion of the surface. The surface of the sheet was observed to contain crystalline oxide and this observation is confirmed by the rings in the diffraction pattern. Next, the surface of one side of the sheet was electrochemically grained. The results are seen in FIG. 4 which is a scanning electron photomicrograph (SEM) of the electrochemically grained surface magnified 1,000 times. Note the uniformity in size and evenness of distribution of craters in the sample. The superior uniformity of size and evenness of distribution of craters on a sheet produced by a process of this invention is surprising and unexpected.

EXAMPLE 3

Figure 5:
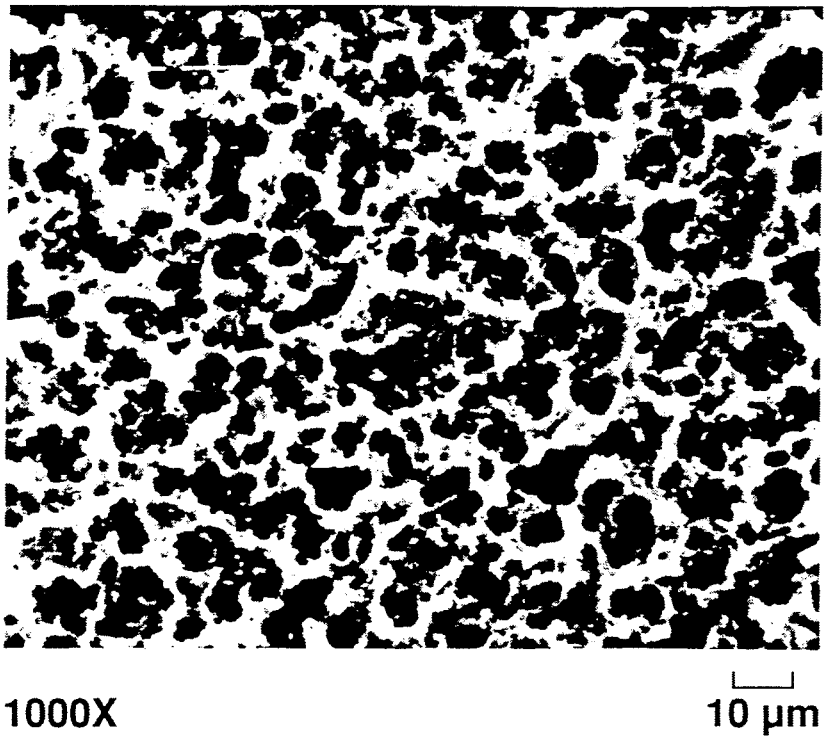
FIG. 5 is a scanning electron photomicrograph (SEM) of the electrochemically grained surface made by a method of this invention, magnified 1,000 times.

A sample of the same sheet of 3103 aluminum alloy as used in Example 1 is subjected to an anneal of the present invention. The anneal is performed by heating the sheet to 950° F. at a rate of 80° F. per hour and holding it at 950° F. for 4 hours. Afterwards the sheet is cooled at a rate of 30° F. per hour until it reaches 750° F. and then held for 4 hours. Next the sheet is cooled at a rate of 50° F. per hour until it reaches 450° F. and then air cooled and cold rolled to a final workgauge of 0.0116 inches. The surface of one side of the sheet was electrochemically grained. The results are seen in FIG. 5 which is a scanning electron photomicrograph (SEM) of the electrochemically grained surface magnified 1,000 times. Note the uniformity in size and evenness of distribution of craters in the sample. The superior uniformity of size and evenness of distribution of craters on a sheet produced by a process of this invention is surprising and unexpected.

EXAMPLE 4

Figure 6:
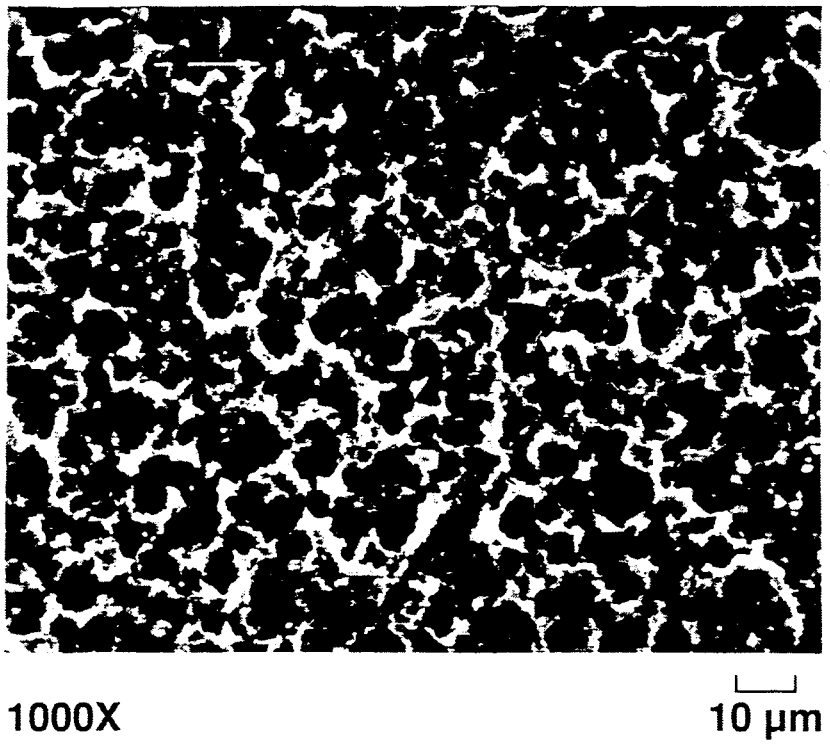
FIG. 6 is a scanning electron photomicrograph (SEM) of the electrochemically grained surface made by a method of this invention, magnified 1,000 times.

A sample of the same sheet of 3103 aluminum alloy as used in Example 1 is subjected to an anneal of the present invention. The anneal is performed by heating the sheet to 950° F. at a rate of 80° F. per hour and holding it at 950° F. for 4 hours. Afterwards the sheet is cooled at a rate of 80° F. per hour until it reaches 450° F. and then air cooled and cold rolled to a final workgauge of 0.0116 inches. The surface of one side of the sheet was electrochemically grained. The results are seen in FIG. 6 which is a scanning electron photomicrograph (SEM) of the electrochemically grained and anodized surface magnified 1,000 times. Note the uniformity in size and evenness of distribution of craters in the sample. The superior uniformity of size and evenness of distribution of craters on a sheet produced by a process of this invention is surprising and unexpected.

EXAMPLE 5

A sample of the same sheet of 3103 aluminum alloy as used in Example 1 is subjected to an anneal of the present invention. The anneal is performed by heating the sheet to 1100° F. at a rate of 80° F. per hour and holding it at 1100° F. for 2 hours. Afterwards the sheet is cooled at a rate of 20° F. per hour until it reaches 920° F. and then air cooled and cold rolled to a final workgauge of 0.0116 inches. The surface of one side of the sheet was electrochemically grained. The surface was found to be uniform in size and evenness of distribution of craters in the sample resembling the surfaces obtained in Examples 2, 3 and 4. The superior uniformity of size and evenness of distribution of craters on a sheet produced by a process of this invention is surprising and unexpected.

EXAMPLE 6

A sample of the same sheet of 3103 aluminum alloy as used in Example 1 is subjected to an anneal of the present invention. The anneal is performed by heating the sheet to 1100° F. at a rate of 80° F. per hour and holding it at 1100° F. for 2 hours. Afterwards the sheet is water quenched and the oxide surface of the sheet is removed by wet grinding. The sheet is then heated to 350° F. and held for 1 hour. Afterwards the sheet is air cooled and cold rolled to a final workgauge of 0.0116 inches. The surface of one side of the sheet was electrochemically grained. The surface was found to be very poorly grained. The removal of the oxide layer after the high temperature intermediate anneal detracted from the uniformity in size and evenness of distribution of craters in the sample.

It is to be appreciated that the invention is susceptible to a number of modifications without departing from the present invention. Thus, for example, the lithoplate alloy need not be 3103. Other lithoplate alloys are also contemplated as being within the scope of the invention. Other lithoplate alloys include 3000 series, 1000 series and 5000 series alloys.

Furthermore, it is contemplated that those skilled in the art will recognize that temperatures other than 950° F. and 1100° F. can be used in practicing the present invention. The temperature used must be above the temperature at which crystalline oxides will form on the surface. This temperature is believed to be just below 800° F.

In addition, the length of time that the sheet will need to be kept at a high temperature will depend on the temperature that is used. For example, at 1100° F., the crystalline growth will be relatively quicker than at 800° F. Thus, when one processes the alloys at 1100° F., it does not need to be held as long to effect the same amount of crystalline growth as sheet annealed at 800° F. It is believed that an anneal of 4 hours at 950° F. is for a much longer period of time than is needed to derive the benefit of the present invention. An anneal of one hour at 800° F. is believed adequate.

Finally, even though the invention has been described in terms of a batch anneal process in which the entire piece of metal is placed in furnace and held for a predetermined time at a predetermined temperature, other annealing processes may also be used. Thus, for example, a continuous or semi-continuous anneal maybe employed in practicing the present invention. In a continuous anneal the sheet is continuously entering and exiting the annealing furnace and only a portion of the metal sheet is at the final annealing temperature at any one time. The type of annealing method which is actually used is not believed to be critical to practicing the invention. As stated above, it is the time and temperature that is critical. Thus if a continuous anneal is performed slowly enough to allow the formation of the the crystalline oxides at the metal surface, it may be used in practicing the present invention.

While the invention has been described in terms of preferred embodiments, the claims appended hereto are intended to encompass all embodiments which fall within the spirit of the invention. The scope of the present invention is indicated by the broad general meaning of the terms in which the claims are expressed.

What is claimed is:

1. A method for producing an aluminum lithoplate comprising:

(a) providing a non-heat treatable aluminum lithoplate alloy;

(b) rolling said alloy to form a sheet or plate;

(c) heating said sheet or plate at a temperature above the temperature at which crystalline oxides will form on the surface of said metal; maintaining said temperature for sufficient time to allow crystalline oxides to form, and (d) cold rolling said sheet or plate stock to a finished gauge workpiece.

2. A method as claimed in claim 1 in which step (c) includes heating said sheet or plate above approximately 800° F.

3. A method as claimed in claim 1 in which step (c) includes heating said sheet or plate above approximately 800° F. for at least 1 hours.

4. A method as claimed in claim 1 in which step (c) includes heating said sheet or plate to cause the formation of crystalline oxides at the interface of the oxide layer and said surface of said metal.

5. A method for producing an aluminum lithoplate comprising:

(a) providing a non-heat treatable aluminum lithoplate alloy;

(b) rolling said alloy to form a sheet or plate;

(c) heating said sheet or plate above approximately 800° F. for at least 1 hour; and (d) cold rolling said sheet or plate stock to a finished gauge workpiece.

6. A method as claimed in claim 5 in which step (a) includes providing an aluminum lithoplate alloy selected from the group of 3000 series alloys, 1000 series alloys, 5000 series alloys with 0.25 to 0.50% magnesium.

7. In the production of lithoplate sheet or plate wherein at least one side of an aluminum alloy sheet is chemically or electrochemically grained, the improvement wherein said sheet or plate is produced by:

heating a sheet of a non-heat treatable aluminum alloy having to native oxide layer thereupon, to cause the formation of crystalline oxides at the interface between the surface of the said aluminum alloy and the native oxide layer.

8. A method as claimed in claim 7 in which said heating includes heating said sheet or plate above approximately 800° F.

9. A method as claimed in claim 7 in which said heating includes heating said sheet or plate above approximately 800° F for at least 2 hours.

10. A method for producing a crystalline grain structure beneath the surface of the oxide layer of an aluminum lithoplate alloy comprising the steps of:

(a) providing a non-heat treatable aluminum lithoplate alloy and rolling it a predetermined gauge; and (b) heating said alloy for above approximately 800° F. for at least 1 hour.

11. A method as claimed in claim 10 in which step (b) includes heating said sheet or plate above approximately 900° F.

12. A method as claimed in claim 10 in which step (b) includes heating said sheet or plate above approximately 900° F. for at least 2 hours.

13. A method as claimed in claim 10 which further includes (c) cold rolling said alloy.

14. A method for treating aluminum to provide a roughened surface thereon suitable for lithographic uses, said method comprising the steps of:

forming an ingot of a non-heat treatable aluminum alloy;

homogenizing said ingot for a period of time suitable to insure homogenization of the ingot;

rolling said ingot;

heating said reroll stock at a temperature and time to cause the formation of crystalline oxides on the surface;

cold rolling the reroll stock to a finished gauge workpiece; and providing means for graining at least one surface of the workpiece.

15. A method as claimed in claim 14 in which said heating includes heating said sheet or plate above approximately 900° F.

16. A method as claimed in claim 14 in which said heating includes heating said sheet or plate above approximately 900° F. for at least 2 hours.

17. A method as claimed in claim 14 in which said rolling step includes:

hot rolling and then cold rolling said ingot.

18. A method as claimed in claim 14 in which said forming step includes:

providing an aluminum lithoplate alloy selected from the group of 3000 series alloys, 1000 series alloys, 5000 series alloys with 0.25 to 0.50% magnesium.

* * * * *

UNITED STATES PATENT AND TRADEMARK OFFICE

CERTIFICATE OF CORRECTION

PATENT NO. : 5,028,276

DATED : July 2, 1991

INVENTOR(S) : Stephen C. Byrne et al

It is certified that error appears in the above-identified patent and that said Letters Patent is hereby corrected as shown below:

On the title page, item [75]:
Under "Inventors" Insert --James R. Weaver, Bettendorf, Iowa--.

Col. 4, line 36 Change "incusions" to --inclusions--.

Signed and Sealed this

Twenty-third Day of March, 1993

*Attest:*

STEPHEN G. KUNIN

*Attesting Officer*

*Acting Commissioner of Patents and Trademarks*